US006644195B2

(12) United States Patent
Stephan

(10) Patent No.: US 6,644,195 B2
(45) Date of Patent: Nov. 11, 2003

(54) METHOD AND DEVICE FOR ADJUSTING AN AIR GUIDE SYSTEM IN A SHEET-FED PRINTING MACHINE

(75) Inventor: Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 14 days.

(21) Appl. No.: 09/755,684

(22) Filed: Jan. 5, 2001

(65) Prior Publication Data

US 2001/0006030 A1 Jul. 5, 2001

(30) Foreign Application Priority Data

Jan. 5, 2000 (DE) ..... 100 00 308

(51) Int. Cl.[7] ..... B41F 23/04
(52) U.S. Cl. ..... 101/487; 101/484
(58) Field of Search ..... 101/487, 484, 101/424.1; 271/309, 206, 202, 196, 183

(56) References Cited

U.S. PATENT DOCUMENTS

| | | | | |
|---|---|---|---|---|
| 5,088,713 A | * | 2/1992 | Hayashi | 271/3.1 |
| 5,092,696 A | * | 3/1992 | Amiroli et al. | 400/611 |
| 5,184,813 A | | 2/1993 | Schwitzky et al. | |
| 5,445,372 A | | 8/1995 | Blaser et al. | |
| 5,931,093 A | * | 8/1999 | Walther et al. | 101/232 |
| 6,142,069 A | * | 11/2000 | Eitel et al. | 101/25 |
| 6,240,843 B1 | * | 6/2001 | Kruger et al. | 101/232 |
| 6,352,027 B1 | * | 3/2002 | Wadlinger | 101/216 |

FOREIGN PATENT DOCUMENTS

| | | |
|---|---|---|
| DE | 2 146 121 | 4/1972 |
| DE | 23 52 864 B1 | 3/1975 |
| DE | 34 13 179 A1 | 10/1985 |
| DE | 42 07 635 A1 | 10/1992 |
| DE | 195 39 598 A1 | 4/1997 |
| DE | 197 14 204 A1 | 10/1998 |
| DE | 197 30 042 A1 | 1/1999 |
| DE | 299 10 696 U1 | 9/1999 |
| EP | 0 503 523 A1 | 9/1992 |
| EP | 0 553 321 B1 | 8/1993 |
| GB | 2 156 786 | 10/1985 |

* cited by examiner

*Primary Examiner*—Charles H. Nolan, Jr.
(74) *Attorney, Agent, or Firm*—Laurence A. Greenberg; Werner H. Stemer; Gregory L. Mayback

(57) ABSTRACT

A method of adjusting an air guide system having various actuators, in a sheet-fed printing machine, includes the method steps of providing characteristic curves containing conveying parameters which are critical for sheet conveyance, plotted against a printing machine-specific parameter, and which are optimal for sheet-specific parameters; storing the characteristic curves in a memory; feeding the actual sheet-specific and printing machine-specific data of a print job to a CPU; accessing by the CPU the characteristic curve which is optimal for the actual data from the memory; outputting the appropriate commands to the individual actuators; and, if necessary, providing operator intervention; and a device for performing the method.

5 Claims, 6 Drawing Sheets

METHOD AND DEVICE FOR ADJUSTING AN AIR GUIDE SYSTEM IN A SHEET-FED PRINTING MACHINE

BACKGROUND OF THE INVENTION

Field of the Invention

The invention relates to a method and device for adjusting an air guide system in a sheet-fed printing machine. Such air guide systems are used to convey and guide printing material, generally a sheet of paper or cardboard. Such a system includes a large number of different air-assisted elements, such as blowing or blast systems, carrying-air cushions and so forth, referred to as "actuators" in connection with this invention.

The air guide system ensures precise conveyance and guidance of the individual sheets, which are held at the leading edge thereof by grippers. In this regard, the greatest accuracy is involved, specifically, both with respect to the path guidance, i.e., the avoidance of deviations from a desired path predefined by the grippers, and also with respect to chronological sequence. Problems increase as the machine speed increases.

The universal availability of a machine for assignment both to the thinnest papers (bible printing paper) and the thickest cardboards requires, on the one hand, a large adjustment range and, on the other hand, a precise adjustment of the air parameters. In particular, this applies to the pressure at the nozzle outlet and, therewith, also the air velocity and the air volume. These air parameters are controlled by throttle valves or bypass flaps, remotely adjustable motorized valves, speed-controlled air generators, and many others. In this regard, the aforementioned parameters which are critical to sheet conveyance, hereinafter referred to as "conveying parameters", are adjusted to the specific data of the respective print job.

Parameters which are sheet-specific are, in particular, the grammage, i.e., the weight of the sheet in $g/m^2$, and the sheet format. However, other variables are also considered, for example, the stiffness of the sheet or the surface condition thereof. It is believed to be obvious that the conveying parameters have to be selected with a view to the sheet parameters in order to achieve an optimum result, i.e., trouble-free conveyance of the sheet through the entire machine. It may also happen that the parameters of a blowing or blast air nozzle, when the sheet parameters are changed, for example, from a lower to a higher grammage, must be changed at a specific location on the conveying path rather than at another location.

PRINTING MACHINE-SPECIFIC PARAMETERS

Parameters which are specific to printing machines are critical for the operation of the blowing or blast air nozzles. The most important printing machine-specific parameter is the production printing speed, i.e., the machine speed. Further printing machine-specific parameters are the switching on and switching off, i.e., starting and stopping, respectively, of individual printing units, the presence of particular in-line applications: varnishing, drying, measuring, cutting, and so forth.

COMBINED PARAMETERS

Printing form or plate inking and moisture takeup change the printing material properties as they pass through the machine.

With regard to heretoforeknown printing machines, the air parameters of the individual air handlers, i.e., for example, blast air nozzles, respectively, are adjustable only individually. Nevertheless, it has become known heretofore to adjust groups of air handlers. In any event, whenever a new print job is performed, a great number of adjustments have to be made, with sheet-specific parameters differing from the preceding print job and/or with different printing machine-specific parameters, for example, at a higher or lower production printing speed.

From the plethora of all of the possible adjustments, the operator has to find the correct adjustment. The operator therefore has to feel his way empirically to the correct values of the conveying parameters in order to achieve a trouble-free or satisfactory conveying result. In this regard, he or she orients himself or herself, respectively, to the aforementioned physical sheet-specific and machine-specific parameters, as well as combined parameters. This requires not only a great deal of skill on the part of the operator, but is also time-consuming. The operator has to decide, from his or her understanding of the technical/physical effect or from his or her own experience, whether upward or downward corrections are necessary in order to optimize the conveying parameters, in particular the air pressure of the blast nozzles.

Previous attempts at a solution to these problems include the following:

The performance range of the machine was restricted to specific applications, in order to achieve a reduction in the adjustment operations of conveying parameters; the performance of the air generators was limited in order to avoid maladjustments; the operating points and viewing windows directly adjacent the sheet guide path were configured ergonometrically; production was performed at a reduced machine speed because, in the daily business of a print shop or printing plant, for the most part the increased changeover time was not amortized by the higher production printing speed achieved as a result.

All these attempts at finding an appropriate solution were unsatisfactory, specifically in relation to the expenditure of time, to the quality of the printed result and also to the requirements regarding the capability and experience of the operator.

The published European Patent Document EP 0 553 321 B2 describes a device for regulating and/or controlling individual actuating elements such as blast nozzles in the region of a delivery of a sheet-fed printing machine. In this regard, sheet-specific and printing machine-specific characteristic data are fed to a computer. In the case of individual actuating elements, a control device performs a format-dependent adjustment. The computer uses the characteristic data to determine the energy of the sheet oncoming in the delivery and, in addition, ensures that the control variables of the actuating elements apply precisely that amount of energy which corresponds to the energy of the oncoming sheet in the delivery region.

The published German Patent Document DE 197 14 204 A1 describes a device for regulating the blast air on a sheet feeder. In this regard, valves which control the supply of blast air are adjusted in accordance with control characteristic curves which, in turn, for its part, take the sheet properties into account.

The published German Patent Document DE 34 13 179 A1 describes a control and regulating device for a sheet delivery of a sheet-fed printing machine. In this regard, all of the required adjustments of adjustable elements of a sheet delivery are adjusted from a single location and are adapted or matched automatically to the changing conditions in accordance with a predefined or prescribed program.

None of these proposals was able to solve the problems arising here. In particular, it is impossible to take into account parameters which are not contained in the database, which leads fundamentally to maladjustments. There is a basic contrast between

| Full automation | Manual adjustment |
|---|---|
| + quick | + flexible |
| + no changeover times | + universal |
| – no possibility of intervention | + maximum performance |
| – never covers 100% of all the parameters | – changeover time very high |
| – many maladjustments | – occur in the machine |
| – not performable by the printer | – not detectable |
| – experience base of the printer remains unused | – possible error |

SUMMARY OF THE INVENTION

It is accordingly an object of the invention to provide a method and device for adjusting an air guide system in a sheet-fed printing machine wherein the individual conveying parameters of actuators, such as blast air nozzles, can be adjusted quickly and automatically, even by less experienced personnel, for specific job data having special sheet-specific and printing machine-specific parameters (preset and adaptation), and the ability to exert a manual influence is maintained so that the advantages of full automation are usable together with those of manual control, excluding the disadvantages, so that an optimal printed result is attained in the shortest time.

With the foregoing and other objects in view, there is provided, in accordance with one aspect of the invention, a method of adjusting an air guide system having various actuators, in a sheet-fed printing machine, which comprises the following method steps: providing characteristic curves containing conveying parameters which are critical for sheet conveyance, plotted against a printing machine-specific parameter, and which are optimal for sheet-specific parameters; storing the characteristic curves in a memory; feeding the actual sheet-specific and printing machine-specific data of a print job to a CPU (central processing unit of a computer); accessing by the CPU the characteristic curve which is optimal for the actual data from the memory; and outputting the appropriate commands to the individual actuators; and, if necessary, providing operator intervention.

In accordance with another mode of the method of the invention, there is provided a method of adjusting an air guide system having blast air nozzles, in a sheet-fed printing machine, which comprises the following method steps: providing characteristic curves containing a conveying parameter of blast air pressure which is critical for sheet conveyance, plotted against the printing machine-specific parameter of the printing machine speed, and which is optimal for a sheet-specific parameter selected from the group thereof consisting of grammage and sheet format, respectively; storing the characteristic curves in a memory; feeding the actual sheet-specific and printing machine-specific data of a print job to a CPU; accessing by the CPU the characteristic curve which is optimal for the actual data from the memory; and outputting the appropriate commands to the individual actuators; and, if necessary, providing operator intervention.

In accordance with a further mode, the method includes, when accessing the optimal characteristic curves, determining at least one concrete condition selected from the group thereof consisting of a turning up of the printing material, a flapping of the printing material, a contact ghosting of the printed image, and a smearing of the printed image, respectively.

In accordance with an added mode of the invention, the method includes, as a scaling function, providing a plot diagram or graph reproducing the effects of the adjustment for various grammages and, consequently, taking the behavior of the printing material into account.

In accordance with an additional aspect of the invention, there is provided a device for regulating and/or controlling an air guide system in a sheet-fed printing machine, the air guide system having various actuators, comprising a memory stored with characteristic curves for reproducing conveying parameters, which are critical for sheet conveyance, plotted against printing machine-specific parameters, and which are optimal for sheet-specific parameters; an input device for inputting actual parameters selected from one of the groups thereof consisting of actual sheet-specific parameters and printing machine-specific parameters, respectively; and a CPU for determining optimal characteristic curves, taking the actual characteristic data into account, and for feeding the relevant parameters to a reference-value or set-point transmitter.

In accordance with a concomitant feature of the invention, there is provided a device for regulating and/or controlling an air guide system, having blast air nozzles as actuators, in a sheet-fed printing machine, comprising a memory stored with characteristic curves for reproducing blast air pressure, as a conveying parameter critical for sheet conveyance, plotted against printing machine speed, as printing machine-specific parameters, and which are optimal for sheet-specific parameters consisting of at least one of grammage and sheet format, respectively; an input device for inputting actual parameters from the groups consisting of actual sheet-specific and actual printing machine-specific parameters, respectively; and a CPU for determining optimal characteristic curves, taking the actual characteristic data into account, and for feeding the relevant parameters to a reference-value or set-point transmitter.

In the foregoing manner, the efficiency of the machine may be optimized, the changeover times may be reduced and the quality and the output capacity can be attained independently of the subjective experience of the operating personnel.

According to the basic concept of the invention, characteristic curves are provided wherein conveying parameters, such as the blast or blowing air pressure, are plotted against printing machine-specific parameters such as the production printing speed, specifically for different print jobs with the sheet-specific parameters thereof, such as the grammage of the sheet or the sheet format.

The aforementioned characteristic curves therefore contain the data for the optimal adjustment for a quite specific printing material, respectively.

Control of the air parameters is performed by evaluating the aforementioned sheet-specific and printing machine-specific parameters. This makes presetting possible. In order to adapt the machine to job-specific conditions, operator intervention in the respective data is then possible. This requires a further variable, which is referred to herein as an "influencing variable". This produces a changed characteristic curve, which then leads to different air adjustments.

It is desirable for the preset adjustment to cover all the practical cases. This is not achieved, however, in practice. What is sought after, however, is that a high percentage be covered, for example 80%. In the remaining number of cases, the pressman must intervene and perform an appropriate adjustment.

According to the invention, when the characteristic curves for the optimal conveying parameters are being provided, a start may be made from physical "abstract" variables, such as from the grammage or the stiffness or the format of the sheet.

In further refinement of the invention, however, provision is made for ignoring these variables completely and, instead, for using quite concrete variables based upon results, such as casting or turning up of the printing material, contact ghosting of the printed image, smearing of the printed image, flapping or fluttering of the printing material, and others.

The pressman is able to assess these conditions or phenomena reliably. The physical background and the effective variables to be attacked by the pressman can be completely disregarded by the pressman in the process. The more extensive teaching according to the invention therefore comprises the following:

Using the aforementioned conditions or events, such as upward turning, contact ghosting, smearing, or flapping or fluttering, the characteristic behavior of the combination of physical parameters (grammage, stiffness, centrifugal force and-so forth) and conveying parameters (blasting force, quantity of air, air pressure and so forth) are systematically recorded in terms of the effect thereof in trials. The characteristic curves are then stored in such a manner that the pressman can register the results of changes as dual decisions of more (+) or less (−). He can therefore close the control loop in a qualified manner without any physical know-how.

These typical and characteristic variables can be used on their own or in addition to the physical variables such as grammage, stiffness and so forth. This is beneficial in the case wherein a large number of parameters act which cannot be registered and evaluated in detail.

Example: the pressman prepares proofs and, in so doing, establishes that there is contact ghosting to a specific extent at a specific location. He or she communicates this observation to the machine. An algorithm or a characteristic curve is inherent to the machine. Because of this, an appropriate correction to the relevant air system is effected thereby in the machine.

Such a procedure is primarily recommended in the case of repeat jobs, wherein job-data storage of the aforementioned type can take place.

Other features which are considered as characteristic for the invention are set forth in the appended claims.

Although the invention is illustrated and described herein as embodied in a method and device for adjusting an air guide system in a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
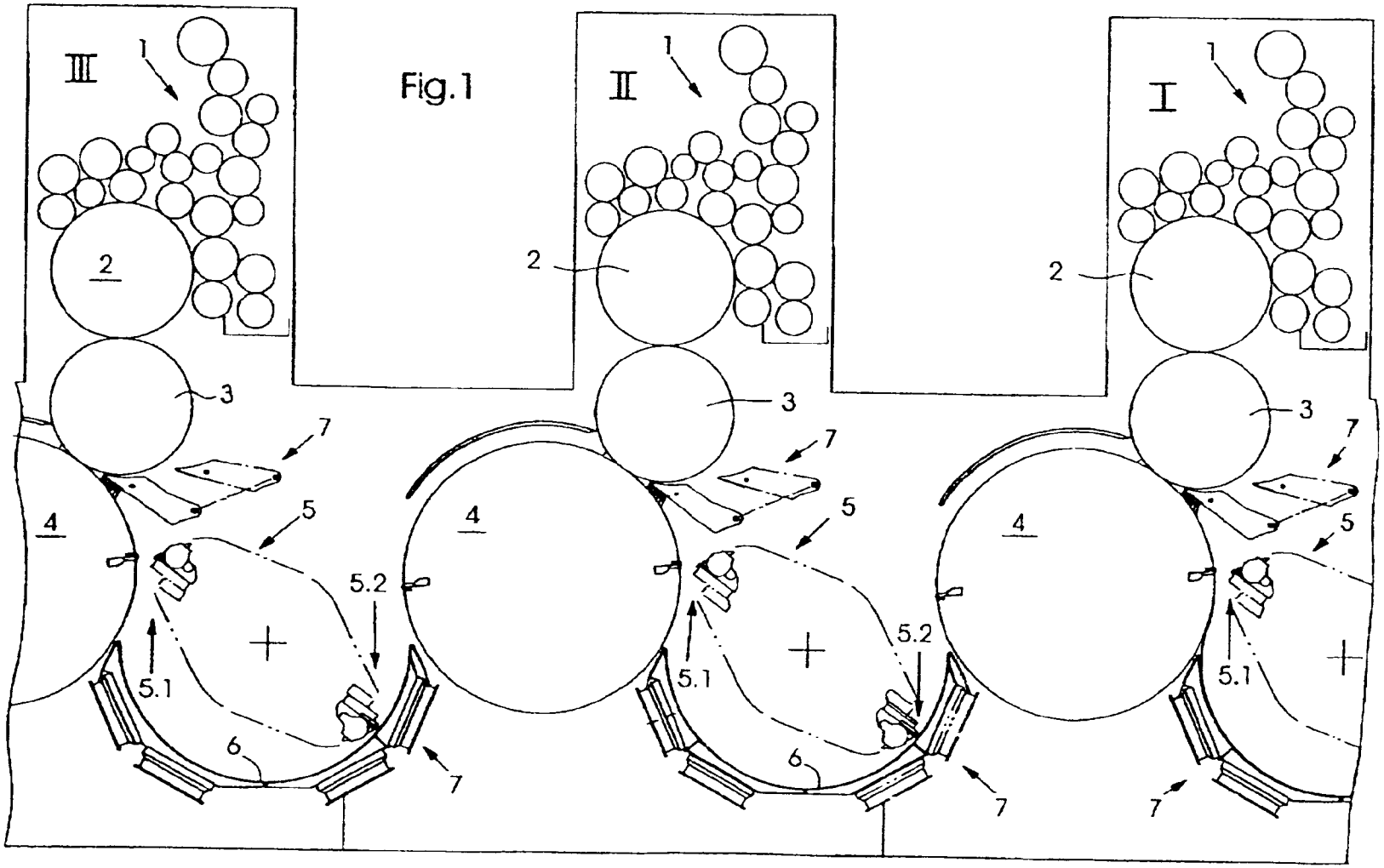
FIG. 1 is a fragmentary diagrammatic side elevational view of a sheet-fed printing machine having a number of printing units, namely three printing units in this embodiment.

Referring now to the drawings and, first, particularly to FIG. 1 thereof, there is shown therein, in a fragmentary view, a sheet-fed printing machine having three printing units I, II and III. Sheets pass through the printing units I, II and III from the righthand side of the figure to the lefthand side thereof.

Each of the printing units I, II and III includes an inking and dampening unit 1, a plate cylinder 2, a blanket cylinder 3 and an impression cylinder 4.

Located between each two successive impression cylinders 4 is a transfer device including a gripper device 5 having two grippers 5.1 and 5.2, a curved sheetmetal guide plate 6 and a number of blowing or blast devices 7.

The individual sheet is guided on the path thereof through the various stations by an air guide system. For example, sheetmetal guide plates 6 are thus arranged in the region of the transfer device. Incorporated in the guide plates 6 are nozzles, which transport the sheet in a contact-free floating position by air flows which emerge in a targeted manner from the respective sheet guide plate 6.

The blowing or blast devices 7 smooth out the sheets to be transported on the impression cylinder, in order to ensure an optimum position of the respective sheet during printing.

It is believed to be readily apparent that additional blowing or blast nozzles are provided, however, they do not have to be discussed at this juncture.

Figure 2:
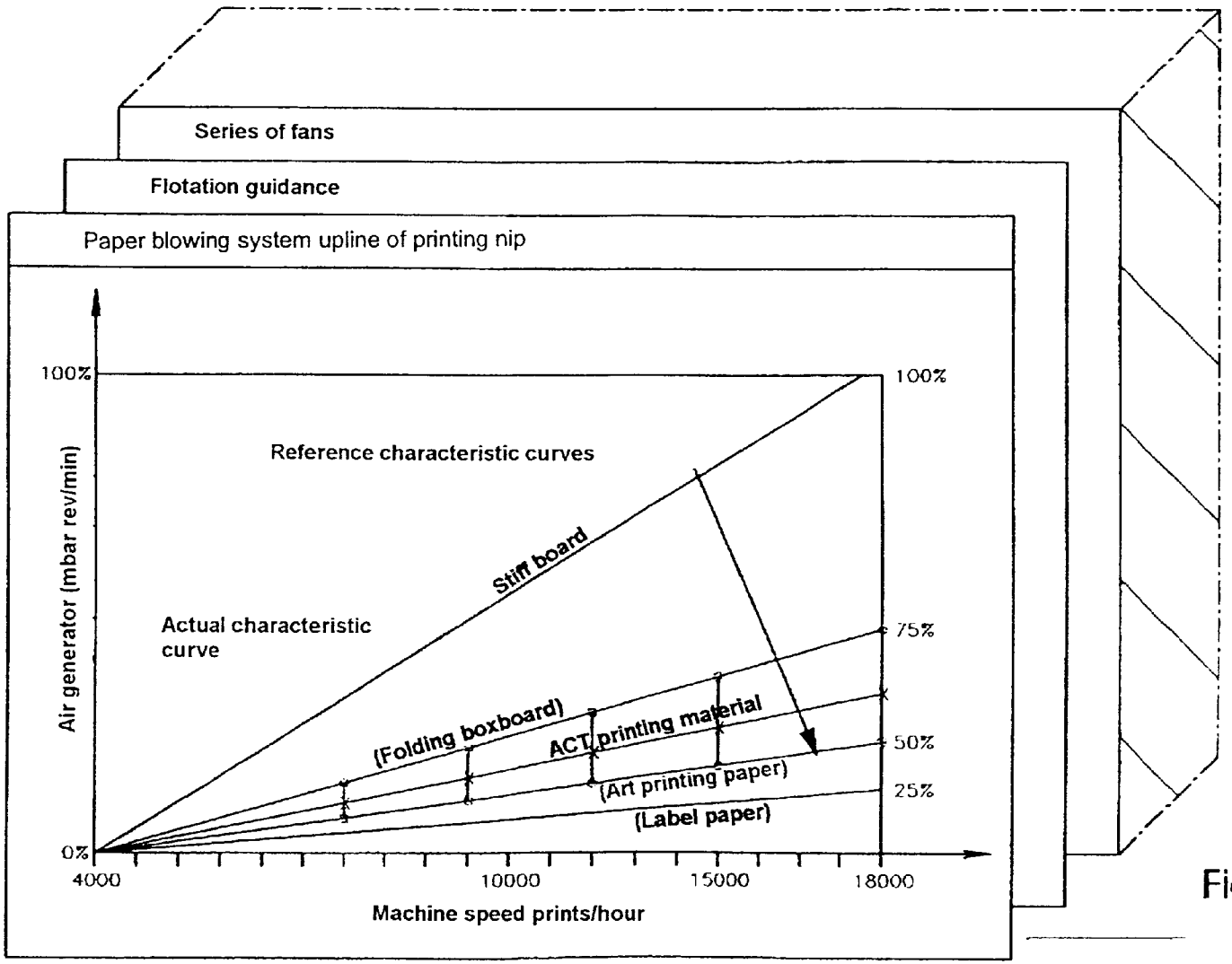
FIG. 2 is a plot diagram showing characteristic curves for different printing materials, plotted as pressure in the air generator against machine speed.

The plot diagram or graph reproduced in FIG. 2 shows a number of characteristic curves. In this case, the "ACT printing material" characteristic curve signifies the characteristic curve determined for an actual or actually then used printing material. Plotted along the ordinate is a characteristic variable which relates to the respective air generator, in the case at hand, by way of example, the variables mbar and rev/min. Plotted along the abscissa is the machine speed, expressed in printing operations per hour. Other critical parameters may also be taken into consideration in the case at hand.

The captions above the plot diagram, namely, "Series of fans", "Flotation guidance", and "Paper blowing system upline of printing nip" refer to various locations at which the use of air is necessary.

Figure 3:
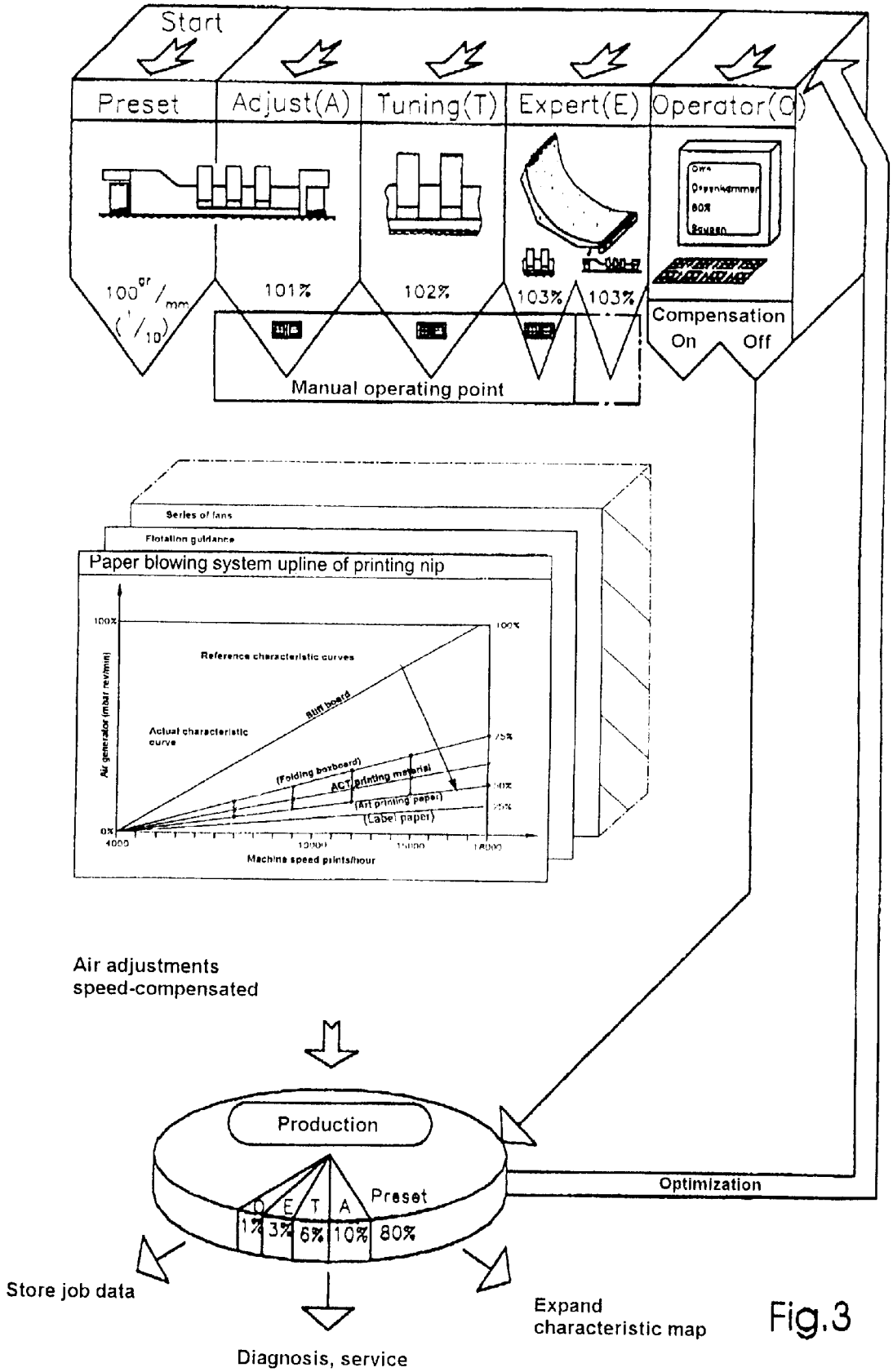
FIG. 3 illustrates an operating concept with respect to sheet guidance, including a reduced version of the plot diagram of FIG. 2.

FIG. 3 illustrates the operating concept of the sheet guidance. At the upper lefthand side of FIG. 3, the condition during the start is illustrated (note "Preset"). The individual parameters are thereby preset.

The pie chart illustrated at the bottom of FIG. 3 reveals the following: The preset adjustment covers 80% of all practical cases, in an assumed case. This means that, in 80% of all cases, the determined basic characteristic curves (note FIG. 4) indicate the respective correct air parameters for a specific machine speed, for example expressed as prints per hour. However, this also means that there are a series of cases wherein this does not apply. In those cases, the pressman has to make an adjustment. In practice, this means the following:

The pressman starts from the aforementioned preset adjustment and produces a few proofs. If the result is satisfactory, then he does not have to make any adjustments. However, if it is not completely satisfactory, for example because the printing material tends to rise up with the production printing speed, or because the specific printing material behaves differently than expected, then the pressman makes an adjustment ("adjust" step).

In the case of the pie chart that is shown, it has been assumed that this will be needed in 10% of all cases.

With the adjust step, all the air handlers are corrected. In that regard, the individual air handlers can be commanded to supply more or less air.

In contrast therewith, the "tuning" step is concerned with influencing the air handlers within a machine relative to one another.

Figure 4:
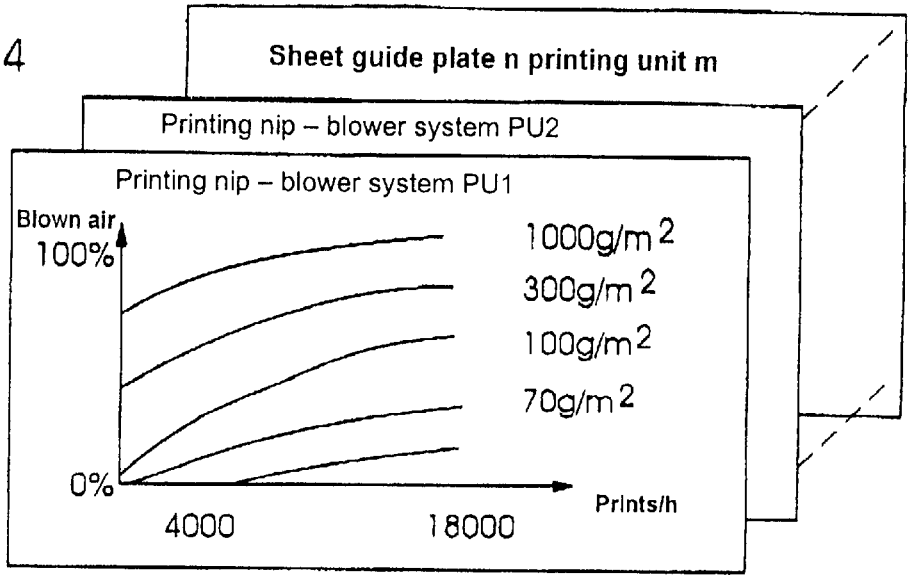
FIG. 4 illustrates a plot diagram like that of FIG. 2. Showing a family of basic characteristic curves.

The plot diagram or graph reproduced in FIG. 4 illustrates a plurality of basic characteristic curves. In this regard, a measure of the use of the relevant printing-nip blower system for the sheet guide plate of a specific printing unit is plotted along the ordinate, and the machine speed is plotted along the abscissa.

Each characteristic curve relates to printing materials with quite specific grammages, expressed in $g/m^2$.

In this way, all the air handlers in the machine are adjusted in accordance with a stored characteristic curve.

Figure 5:
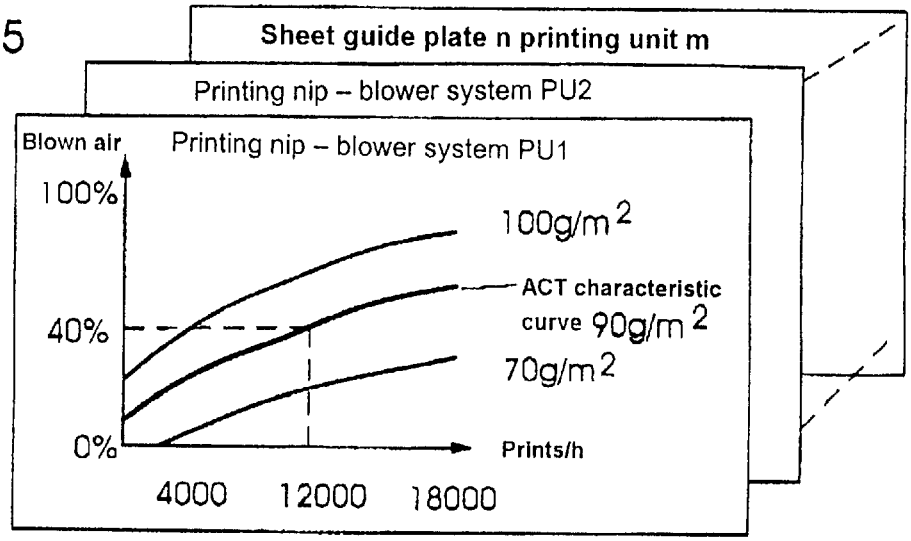
FIG. 5 is a plot diagram like that of FIG. 4, showing a selected characteristic curve during a "preset" step.

FIG. 5 illustrates a selected characteristic curve during the preset step. The printing material has a grammage of 90 $g/m^2$. The machine speed is 12,000 prints/hour. On the ordinate, this results in a value of 40% of the capacity of the air generator.

Figure 6:
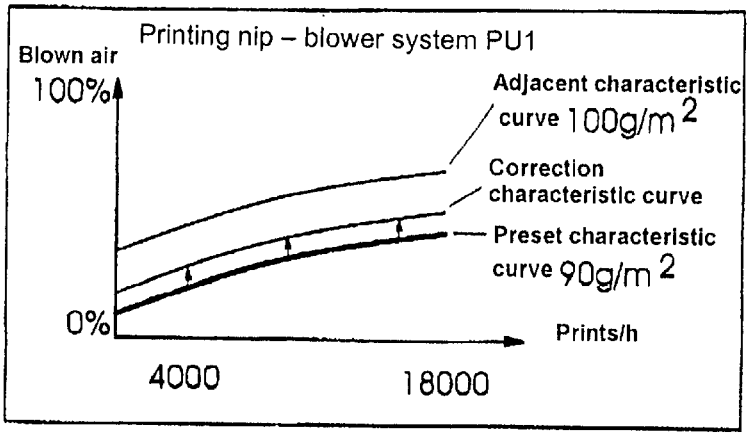
FIG. 6 is another plot diagram like those of FIGS. 4 and 5, for example, illustrating the adaptation of a specific characteristic curve.

FIG. 6 illustrates the adaptation of the selected characteristic curve, i.e., that characteristic curve illustrated in FIG. 5, by "adjust", "tuning", and "expert".

The individual steps mentioned above occur as follows:

Adjust:

Based upon the printed result, the operator makes a correction to the selected characteristic curve, thus, that characteristic curve which is reproduced in FIG. 5. This correction is advantageously made by adapting the respective characteristic curve of all the handlers (actuators) in the machine. It can be performed, for example, by interpolating between the ACT printing material and the nearest adjacent characteristic curve.

The "adjust" step in this case influences all the handlers in the machine in a suitable manner.

Tuning:

Tuning is performed for individual printing units or groups of printing units, for example in printing units 4 to 8 of a machine.

Expert:

The "expert" step acts upon a single actuator or upon all identical actuators in the machine (for example, respectively, on the sheet guide plate 1 in one or more of the printing units 1 to 8).

Operator:

The "operator" step permits the input of the desired adjustment of the respective actuator without switching on a characteristic curve (compensation off). The value is therefore input directly by the operator. This mode corresponds to operating a machine with throttling points.

Figure 7A:
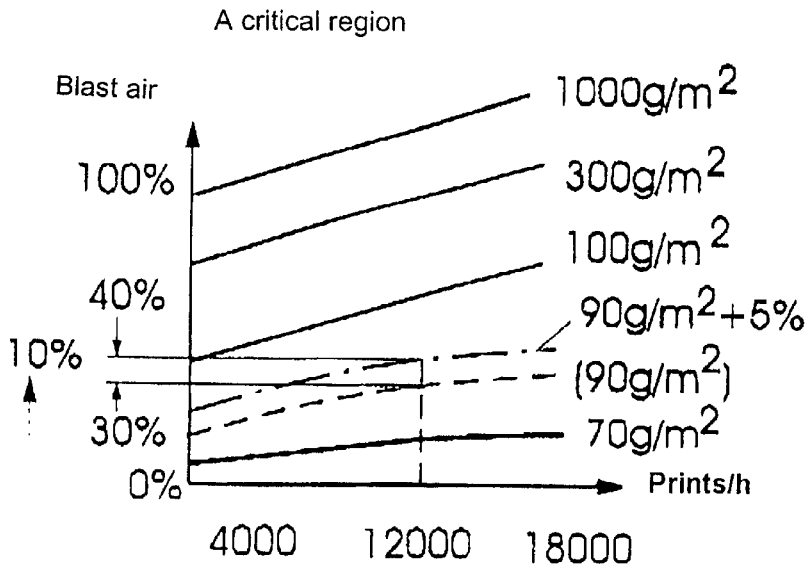
FIGS. 7*a*, 7*b* and 7*c* are plot diagrams illustrating different response behavior of individual handlers when one and the same correction is made.
Figure 7B:
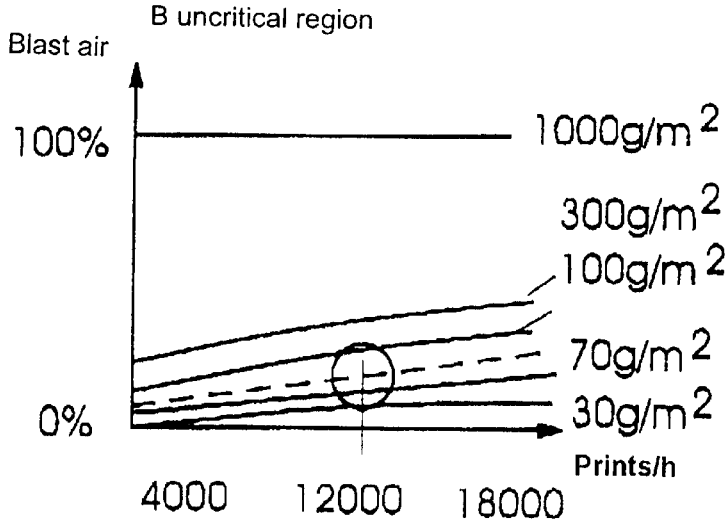
Figure 7C:
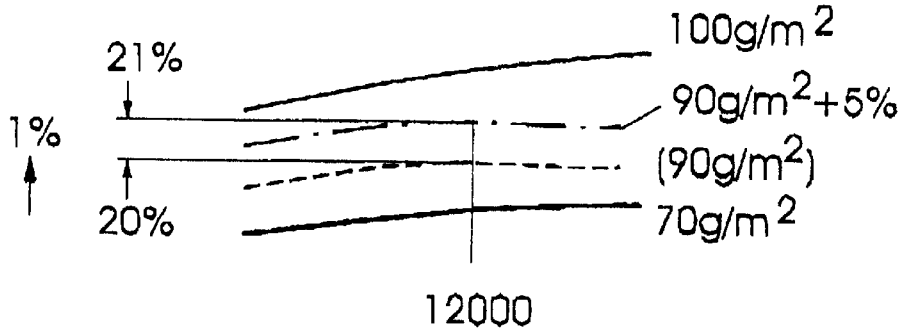

FIGS. 7*a*, 7*b* and 7*c* illustrate the different response behavior of various handlers to a specific correction.

If a correction of one and the same amount, for example, 5%, is made over the entire machine to the operation of the air generator by depressing the plus or minus key, then the actuators will react differently, depending upon the stored field or family of characteristic curves:

A) A handler in the critical or highly overdriven area has a large differential value with reference to the adjacent characteristic curves. Any change in the influencing variable in this case means a large change in the air parameters. Note the graph in FIG. 7*a*.

B) By contrast, a handler in the uncritical or weakly overdriven area reacts only slightly to the aforementioned change. Note the plot diagram in FIG. 7*b*. This uncritical area is present, for example, in the case of sheet guide plates. In this regard, the occurrence in the encircled area in FIG. 7*b* is illustrated on an enlarged scale in FIG. 7*c*.

Figures 8A, 8B, 8C:
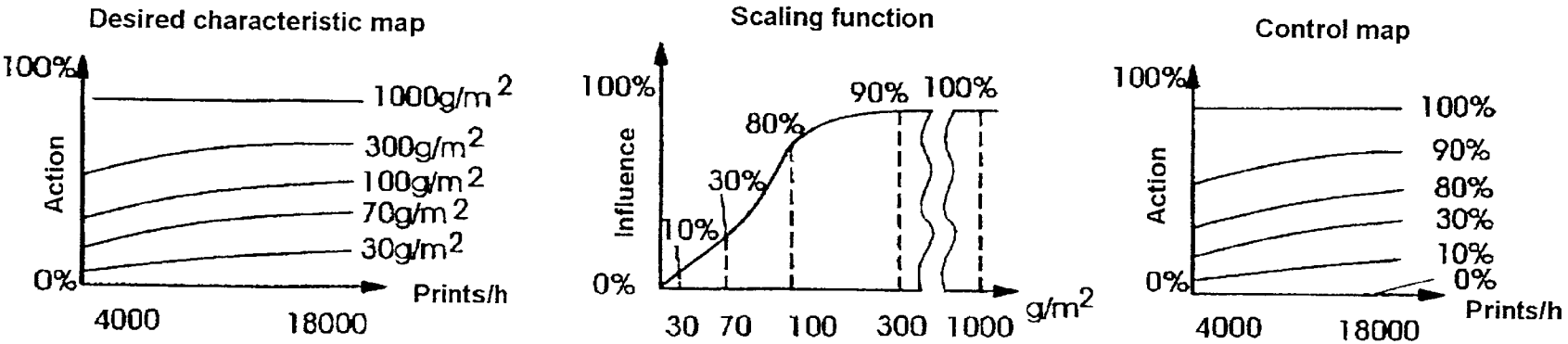
FIGS. 8*a*, 8*b* and 8*c* are further plot diagrams illustrating what happens when a parameter, such as grammage, for example, is changed.

The tie-in or linkage for solving the problems of operator intervention may be provided in different ways:

a) by accommodating the nearest additional influencing parameters into the n-dimensional field of parameters, for example:

grammage (so-called weight per unit area),
format,
stiffness,
speed,
operator intervention b) by changing a parameter, for example the grammage. This occurs preferably when, in order to reduce the quantity of data, the operation is sought to be performed with only a few influencing variables. Note FIGS. 8*a*, 8*b* and 8*c*. In this regard, the graph in FIG. 8*a* shows the desired characteristic field or map, FIG. 8*b* shows the scaling function, and the plot diagram of FIG. 8*c* shows the control field or map.

A further variable, in addition to the machine speed, if necessary or desirable, the single further variable, is converted or recalculated in accordance with a predefined or prescribed rule (scaling function) into an auxiliary variable (0 to 100%). The operating influencing variable is then simply added thereto, for example, 90 $g/m^2$>60%; in the case of a 2% plus correction>62%.

The scaling function illustrates the effects resulting from the adjustment which the pressman performs for the various grammages. The scaling function therefore automatically takes into account the printing-material behavior. The control map or field illustrated in FIG. 8*c* is a result of the scaling function.

I claim:

1. A method of adjusting an air guide system having various actuators, in a sheet-fed printing machine having various printing stations, which comprises the following method steps:

guiding a sheet on a path through the various printing stations by the air guide system within the sheet-fed printing machine;

providing characteristic curves containing conveying parameters which are critical for sheet conveyance, plotted against a printing machine-specific parameter, and which are optimal for sheet-specific parameters;

storing the characteristic curves in a memory;

feeding the actual sheet-specific and printing machine-specific data of a print job to a CPU;

accessing by the CPU the characteristic curve which is optimal for the actual data from the memory;

outputting the appropriate commands to the individual actuators; and if necessary, providing operator intervention based on a result of determining at least one definite condition selected from the group consisting of a turning up of a printing material, a flapping of the printing material, a contact ghosting of a printed image, and a smearing of the printed image.

2. A method of adjusting an air guide system having blast air nozzles, in a sheet-fed printing machine having various printing stations, which comprises the following method steps:

guiding a sheet on a path through the various printing stations by the air guide system within the sheet-fed printing machine;

providing characteristic curves containing a conveying parameter of blast air pressure which is critical for sheet conveyance, plotted against the printing machine-specific parameter of the printing machine speed, and which is optimal for a sheet-specific parameter selected from the group thereof consisting of the grammage and the sheet format, respectively;

storing the characteristic curves in a memory;

feeding the actual sheet-specific and printing machine-specific data of a print job to a CPU;

accessing by the CPU the characteristic curve which is optimal for the actual data from the memory;

outputting the appropriate commands to the individual nozzles; and if necessary, providing operator intervention based on a result of determining at least one definite condition selected from the group consisting of a turning up of a printing material, a flapping of the printing material, a contact ghosting of a printed image, and a smearing of the printed image.

3. The method according to claim 1, which comprises, as a scaling function, providing a plot diagram or graph reproducing the effects of the adjustment for various grammages and, consequently, taking the behavior of the printing material into account.

4. A device for regulating and/or controlling an air guide system in a sheet-fed printing machine having various printing stations, comprising:

air guide devices guiding a sheet on a path through the various printing stations within the sheet-fed printing machine;

a memory stored with characteristic curves for reproducing conveying parameters, which are critical for sheet conveyance, plotted against printing-machine-specific parameters, and which are optimal for sheet-specific parameters;

an input device for inputting actual parameters selected from one of the groups thereof consisting of actual sheet-specific parameters and printing machine-specific parameters, respectively; and a CPU for determining optimal characteristic curves, taking the actual characteristic data into account, for feeding the relevant parameters to a reference-value or set-point transmitter and for deciding if an operator intervention is necessary based on a result of determining at least one concrete condition selected from the group consisting of a turning up of a printing material, a flapping of the printing material, a contact ghosting of a printed image, and a smearing of the printed image.

5. A device for regulating and/or controlling an air guide system in a sheet-fed printing machine having various printing stations, comprising:

air guide devices guiding a sheet on a path through the various printing stations within the sheet-fed printing machine;

a memory stored with characteristic curves for reproducing blast air pressure, as a conveying parameter critical for sheet conveyance, plotted against printing machine speed, as printing machine-specific parameters, and which are optimal for sheet-specific parameters consisting of at least one of grammage and sheet format, respectively;

an input device for inputting actual parameters from the groups consisting of actual sheet-specific and actual printing machine-specific parameters, respectively; and a CPU for determining optimal characteristic curves, taking the actual characteristic data into account, for feeding the relevant parameters to a reference-value or set-point transmitter and for deciding if an operator intervention is necessary based on a result of determining at least one concrete condition selected from the group consisting of a turning up of a printing material, a flapping of the printing material, a contact ghosting of a printed image, and a smearing of the printed image.

* * * * *